US005615484A

United States Patent [19]

Pittman

[11] Patent Number: 5,615,484

[45] Date of Patent: Apr. 1, 1997

[54] CAM LOCK FOR FOLDING KNIFE BLADE

[75] Inventor: Leon Pittman, Pendergrass, Ga.

[73] Assignee: Spyderco, Inc., Golden, Colo.

[21] Appl. No.: 455,501

[22] Filed: May 31, 1995

[51] Int. Cl.[6] ..... B26B 1/04

[52] U.S. Cl. ..... 30/161; 30/155; 30/344

[58] Field of Search ..... 30/161, 155, 344, 30/342, 157

[56] References Cited

U.S. PATENT DOCUMENTS

| | | | |
|---|---|---|---|
| 1,864,011 | 6/1932 | Brown | 30/155 |
| 1,994,215 | 3/1935 | Gaunt | 30/155 |
| 4,604,803 | 8/1986 | Sawby | 30/161 X |
| 5,060,379 | 10/1991 | Neely | 30/161 X |
| 5,093,995 | 3/1992 | Jan | 30/161 X |
| 5,131,149 | 7/1992 | Thompson et al. | 30/161 X |
| 5,325,588 | 7/1994 | Rogers | 30/161 X |
| 5,425,175 | 6/1995 | Rogers | 30/161 X |

FOREIGN PATENT DOCUMENTS

| | | | |
|---|---|---|---|
| 49412 | 12/1994 | France | 30/155 |

*Primary Examiner*—Rinaldi I. Rada
*Assistant Examiner*—Boyer Ashley
*Attorney, Agent, or Firm*—Roger A. Marrs

[57] ABSTRACT

A cam lock for the folding blade of a knife is disclosed herein wherein the heel of the knife is pivotally carried between opposite sides at one end of a handle. The handle includes an elongated slot defined between opposing surfaces of the handle for receiving the blade in its folded or storage position. A self-biasing cam lock assembly having components carried on the heel of the blade and the handle maintains the blade in its operative extended, unfolded position or in its folded storage position. The cam lock assembly includes an L-shaped cam member secured to the blade heel having an arcuate surface terminating at one end in a linear surface and a cut-out at its opposite end. Rectilinear slide members are carried on the handle having a spring bias yieldably urging the pin and slide member into engagement with either the cut-out or the linear surface respectively to maintain the blade in either of its two positions.

5 Claims, 1 Drawing Sheet

CAM LOCK FOR FOLDING KNIFE BLADE

Claim of priority based on copending application having Ser. No. 08-130,912 filed Oct. 4, 1993, now abandoned.

BACKGROUND OF THE INVENTION

1. Field of the Invention

The present invention relates to the field of locking means for the blade of a folding knife, and more particularly to a novel finger-operated latch having spring means for maintaining the blade in either a folded or unfolded position.

2. Brief Description of the Prior Art

In the past, it has been the conventional practice to fold a blade into a storage position within the handle of a knife and to unfold the blade into an extended or operative position. In most instances, a locking mechanism is provided for maintaining the knife in the extended position so that it will not inadvertently fold while in use. Generally, the latch for holding the blade in the extended position is spring-biased and is releasable by the hand of the user. However, problems and difficulties have been encountered with such locking assemblies which stem largely from the fact that although the latch of the lock is operative to maintain the blade in its unfolded and extended position, no means is provided for releasably locking the blade in the folded position. Therefore, after the blade has been used for many times, it may become loose at its pivot connection with the handle so that the tendency of the blade to drop out of its storage slot in the handle of the knife is oftentimes experienced. Also, there is no positive control over the blade in its stored and extended positions so that the looseness of the blade at its connection with the handle often results in damage to the blade and injury to the user. Another problem with conventional knives and locking assemblies resides in the fact that conventional knives do not provide an appropriate feel for the blade in its travel from the open to the closed position.

Therefore, a long-standing need exists to provide a novel locking mechanism for a knife blade which not only provides an appropriate "feel" for the blade throughout its travel between its open and closed positions but also provides a positive locking action for the blade with respect to the handle when the blade is in its extended operative position or when it is in its closed storage position.

SUMMARY OF THE INVENTION

Accordingly, the above problems and difficulties are avoided by the present invention which provides a novel locking assembly for a knife blade with respect to its handle which incorporates a movable slide member or latch having opposite ends and which is slidably mounted in the handle of the knife. The latch includes an exposed finger engaging portion so that the latch may be readily activated by the thumb of the user. The heel of the blade is pivotally carried on the end of the knife and includes a rounded surface terminating at one end in a first cut-out and terminating at its opposite end in a second cut-out. A cam member is secured to the blade heel which carries an arcuate convex surface separating a pair of parallel linear surfaces. The latch includes an arcuate concave surface at its end facing the cam member while the opposite end of the latch includes a spring means for normally biasing the latch so that its end carrying the arcuate concave surface will engage with the cam member convex surface as the blade is moved between its open and closed position. When the blade is in its operative or open position, the latch engages with a first linear surface while the first cut-out of the blade heel engages with a stop pin. When the blade is in its storage position, the end of the latch engages with the second linear surface of the cam member with the second cut-out engaging the stop pin. When the blade is in movement between its open and closed positions, the arcuate concave surface of the latch operates as a cam follower with respect to the arcuate convex cam surface carried on the cam member so that an appropriate feel to the blade is experienced by the user throughout the blade's travel from the open to the closed position. As the blade travels between its two positions, the spring-biasing means places a tension on the blade which accounts for the appropriate feel.

Therefore, it is among the objects of the present invention to provide a novel locking mechanism for a knife blade which provides an appropriate "feel" for the blade throughout its travel between open and closed positions.

Another object of the present invention is to provide a novel locking means for a foldable blade which includes a cam and cam follower mechanism providing an appropriate feel to the closure procedure and opening procedure while at the same time providing for positive locking action to maintain the blade in either its open or its closed position.

Yet another object of the present invention is to provide a novel locking assembly for a knife having a foldable blade which comprises a slidable latch carried on the handle that is resiliently biased into contact with a cam member carried on the heel of the blade so that the blade is locked in its open position and locked in its closed position while providing a tensioned movement of the blade between its two positions by means of cam and spring-biasing action.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
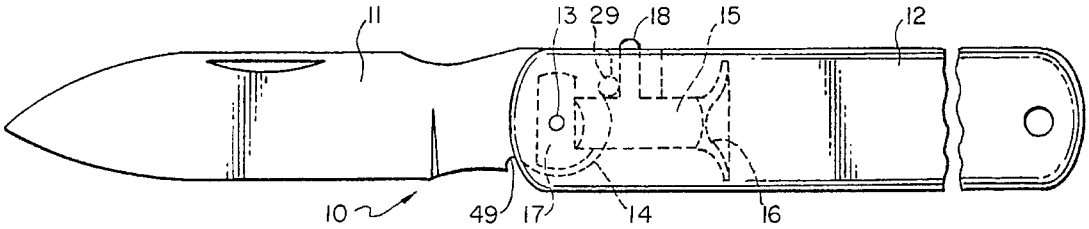
FIG. 1 is a side elevational view of a foldable blade knife incorporating the locking mechanism of the present invention.

The folding knife of the present invention incorporating the novel cam lock mechanism is illustrated in the general direction of arrow 10 which includes an elongated blade 11 having a heel or one end pivotally carried on a handle 12 by means of a pivot connection 13. The pivot is fixedly carried on one end of the handle 12 and passes through the heel 14 integral with the blade 11.

The cam lock mechanism includes an elongated slide member 15 movably carried in a slot on the handle 12 which includes one end bearing against a spring means 16 adapted to normally bias the latch member 15 into engagement with a cam member 17 carried on the heel 14 of the blade 11. The slide member or latch 15 includes a finger engaging portion 18 which is intended to be engaged by the finger of the user, such as the thumb, for moving the latch member 15 in a rectilinear manner within its slide mount on the handle 12 so as to place its end opposite to its end adjacent spring 16 into and out of engagement with the cam lock member 17.

Referring now in detail to FIG. 1, the blade 11 is illustrated in its extended or open position with respect to the handle 12 and it can be seen that the spring means 16 normally biases the latch member 15 into engagement with the cam member 17. Furthermore, it can be seen that the cam member 17 is of an "L-shaped" configuration in side elevational view and that the one side of the member includes a linear surface 20 while the opposite side of the member includes a cut-out portion 21 with a linear surface 19. In the blade open position, the cut-out 21 faces the end of latch member 15 which is formed with a semicircular concave surface 22 that terminates in engagement points 23 and 24 respectively that are in engagement with the cut-out linear surface 19 in the blade open and locked position.

Blade 11 is prevented from over-rotating by a stop pin 29 secured on the handle that interferes with blade travel when engaged with a notch 39.

Figure 2:
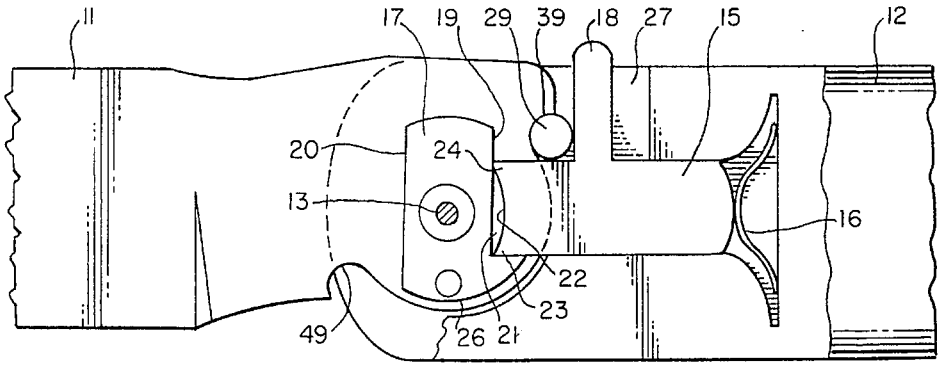
FIG. 2 is an enlarged fragmentary view having a portion of the handle broken away to expose the locking assembly with the blade in its extended or open position.
Figure 3:
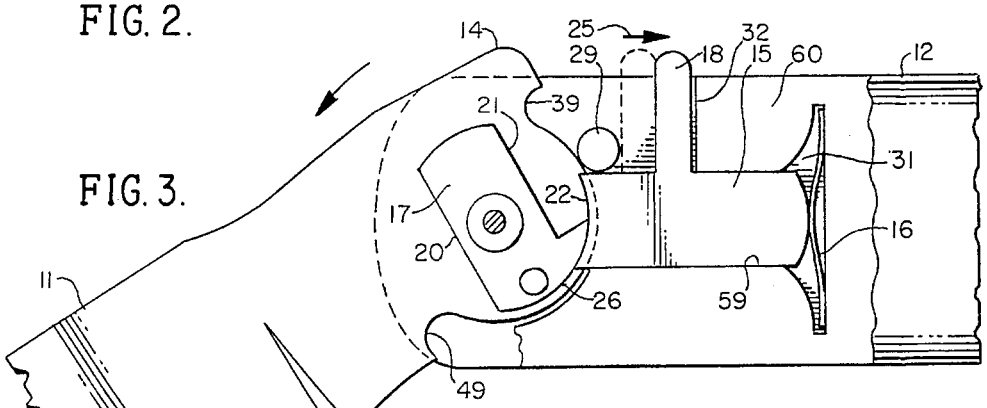
FIG. 3 is a view similar to the view of FIG. 2 illustrating the latch of the lock mechanism moved against the bias of its spring in order to permit folding of the blade with respect to the handle.
Figure 4:
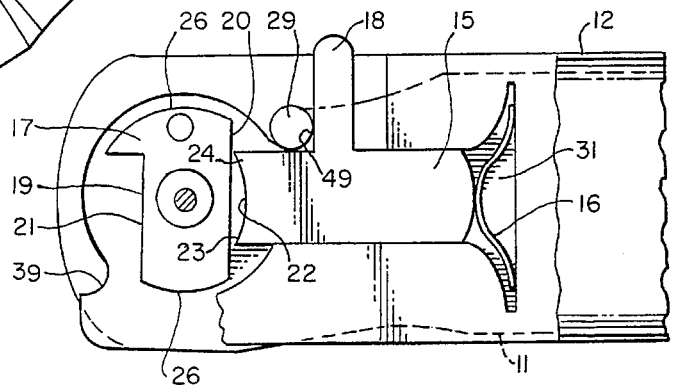
FIG. 4 is a view similar to the views of FIGS. 2 and 3 illustrating the blade in its closed or storage position so that it is locked by the lock assembly.

Referring now in detail to FIG. 3, it can be seen that the blade 11 is in transit between its open position, as shown in FIG. 2, and its closed or stored position shown in FIG. 4. While in transit, the slide member 15 has been manually moved in the direction of arrow 25 from its dotted line position so that the tension of spring 16 is overcome and the blade is permitted to pivot. At this time, a cam surface 26 carried on cam member 17 between the cut-out 21 and the linear surface 20 is engaged by the cam follower or semicircular concave surface 22. The end of the latch is removed from the cut-out 21 and as the arcuate surfaces of the cam 26 and the surface 22 engage, the tension of spring 16 places a load or pressure against the heel of the blade so that a "feel" is given to the user whereby control of the blade is positive and constantly maintained. It can also be seen that the latch member 15 is slidably mounted within a slot 59 provided in a spacer plate 60 between the sides 27 or 28 comprising the handle 12.

Referring now in detail to FIG. 4, the blade 11 is illustrated in its fully closed or stored position whereby the cam member 17 has been rotated with the heel of the blade to the point where the linear surface 20 is in opposing relationship With respect to the end of the latch member 15. As the latch member is released by the finger of the user, the spring bias of spring 16 forcibly urges the contact points 23 and 24 at the end of the arcuate curve 22 into contact with the linear surface 20 to effect locking. This forcible engagement prevents the blade from falling or dropping out of its storage position. The engagement of stop pin 29 with the notches 39 and 49 prevents over-rotation in either direction.

Figure 5:
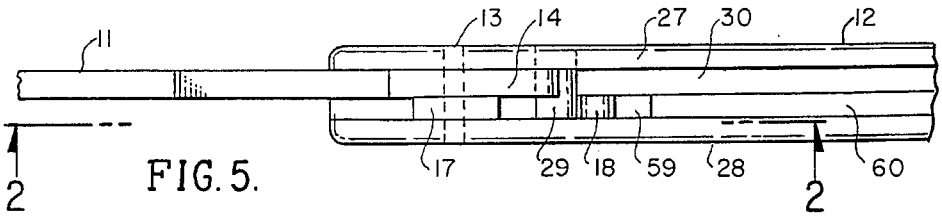
FIG. 5 is a top plan view of the folding blade knife illustrated in FIGS. 1–4 inclusive.

With respect to FIG. 5, it can be seen that the handle sides 27 and 28 are separated by the thickness of the blade heel 14 as well as the thickness of the cam member 17 within an opening 59. Behind the is a storage space 30 defined by the opposing side surfaces of handle sides 27 and 28. A spacer can also be provided at the other end of the handle to effect separation and definition of the storage slot.

In view of the foregoing, it can be seen that the novel cam lock mechanism of the present invention not only provides a positive locking action so that the blade can be releasably locked into its open or extended position, as shown in FIG. 1, or locked into its storage or closed position, as shown in FIG. 4. Although a leaf-spring 16 is illustrated, it is to be understood that the resilient means may take other forms than a leaf-spring. For example, one or several coil springs may be placed within the spring chamber broadly identified by numeral 31 or other materials of a resilient nature may reside within the chamber. Also, the finger-engaging portion 18 although exposed above the top of the handle, it must be appreciated that the finger-engaging portion 18 moves with the main body of the latch 15 and moves between its engagement with the heel of the knife blade, as shown in FIG. 2, and a rear stop 32, as indicated in FIG. 3.

It is to be understood that the thumb-engaging portion 18 may extend from the top of the handle as illustrated or may extend downwardly from the bottom or underside of the handle.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A knife having a positive action lock assembly comprising:

a handle;

a knife blade having a rounded end pivottally carried on said handle and said knife blade movable between an open extended position coextensive with said handle and a closed position within said handle;

a movable latch member carried on said handle having opposite ends, one end of which being to one side with respect to said knife blade rounded end;

a cam member secured on said knife blade rounded end and having a pair of spaced-apart parallel engagement surfaces joined by and separated by a curved portion;

spring means disposed on said handle normally biasing said latch member towards said cam member;

said latch member in engagement with a selected one of said engagement surfaces to releasably lock said blade in said open extended position and in engagement with the other engagement position and in engagement with the other engagement surface of said pair to releasably lock said blade in said closed position;

said latch member includes a concave semicircular portion provided at said selected end of said latch member;

said concave semicircular portion in slidable relationship with said cam member curved portion when said blade is in transit between said open extended position and said closed position; and said latch member includes a pair of engagement points separated by said concave semicircular portion selectively and alternatively engageable with said cam member engagement surfaces to yieldably hold said blade in either one of said open or closed positions.

2. The invention as defined in claim 1 wherein:

said handle includes an elongated cavity slidably mounting said latch member for rectilinear movement therein and said latch member having an end engageable with either of said cam member engagement surfaces to lock said blade in either said open position or said closed position;

a finger-engaging section carried by said latch member outwardly projecting from said cavity beyond said handle for manual urging of said latch member for said rectilinear movement.

3. The invention as defined in claim 1 wherein:

said blade rounded end having a pair of notches in fixed spaced-apart relationship; and a stop pin secured to said handle adjacent said latch engageable with either one of said pair of notches to stop rotation of said blade in either said extended position or said closed position.

4. The invention as defined in claim 3 wherein:

said concave semicircular portion slidably engages with said cam member curved portion in a yieldable frictional and slidable relationship during transit of said blade between said positions.

5. A knife having a positive action lock assembly comprising:

a handle;

a knife blade having a rounded end pivotally carried on said handle and said knife blade movable between an open extended position coextensive with said handle and a closed position within said handle;

a movable latch member carried on said handle having opposite ends, one end of which being to one side with respect to said knife blade rounded end;

a cam member secured on said knife blade rounded end and having a pair of spaced-apart parallel engagement surfaces joined by and separated by a curved portion;

spring means disposed on said handle normally biasing said latch member towards said cam member; said latch member in engagement with a selected one of said engagement surfaces to releasably lock said blade in said open extended position and in engagement with the other engagement position and in engagement with the other engagement surface of said pair to releasably lock said blade in said closed position;

said handle includes an elongated cavity slidably mounting said latch member for rectilinear movement therein and said latch member having an end engageable with either with either of said cam member engagement c surfaces to lock said blade in either said open position or said closed position; and a finger-engaging section carried by said latch member outwardly projecting from said cavity beyond said handle for manual urging of said latch member for said rectilinear movement.

* * * * *